US005143422A

United States Patent [19]

Althofer et al.

[11] Patent Number: 5,143,422

[45] Date of Patent: Sep. 1, 1992

[54] ADJUSTABLE ACTIVE ARM SUPPORT FOR KEYBOARD OPERATORS

[76] Inventors: Gerd Althofer, 440 E. 79th St., New York, N.Y. 10021; Richard M. Kowal, 23 W. 73rd St., New York, N.Y. 10023

[21] Appl. No.: 688,289

[22] Filed: Apr. 22, 1991

[51] Int. Cl.[5] ..... A47C 7/54

[52] U.S. Cl. ..... 297/411; 297/417; 297/414; 297/115

[58] Field of Search ..... 297/411, 417, 115, 117, 297/414, 415, 116; 248/118, 118.1, 118.3

[56] References Cited

U.S. PATENT DOCUMENTS

| | | | |
|---|---|---|---|
| D. 182,211 | 2/1958 | Weill | 297/411 X |
| 1,104,615 | 7/1914 | Braden | 297/417 X |
| 1,721,221 | 7/1929 | Jauregui | 297/411 X |
| 1,743,802 | 1/1930 | Andress | 297/417 X |
| 2,766,463 | 10/1956 | Bendersley | 297/411 X |
| 3,926,473 | 12/1975 | Hogan | 297/414 X |
| 4,159,148 | 6/1979 | Schulz | 297/411 X |
| 4,277,102 | 7/1981 | Aaras et al. | 297/411 |
| 4,978,171 | 12/1990 | Tateyama | 297/417 |

*Primary Examiner*—Kenneth J. Dorner
*Assistant Examiner*—Milton Nelson, Jr.
*Attorney, Agent, or Firm*—Larson and Taylor

[57] ABSTRACT

An active arm support is provided for a chair which takes the weight of the arms and forearms off the shoulders, back and neck of the user while typing so as to support the arms of a typist in the same manner that a chair supports the body. The active arm support provides full arm and forearm support and is vertically adjustable and laterally adjustable and pivots horizontally and vertically while fully supporting the entire forearm. A hinge with a variable spring provides an assisted vertical lift while fully supporting the entire forearm. The presently disclosed active arm support releases the upper trapezius muscles from efforts to support the arms and forearms to provide relaxation in the neck and shoulders of the user, while actually performing typing and other tasks.

10 Claims, 4 Drawing Sheets

1
24
23
20
19
18
18
21
16
15
17
14
11
13
1
5
4
2
9
8
7
6
3
11

ADJUSTABLE ACTIVE ARM SUPPORT FOR KEYBOARD OPERATORS

BACKGROUND OF THE INVENTION

The present invention is directed towards providing an active arm support for a typist, the active arm support having adjustability vertically, horizontally and pivotally and in addition providing an adjustable lifting force to minimize typing-related muscle stresses.

The prior art discloses many types of adjustable armrests for use with various types of seats. The Johnson U.S. Pat. No. 4,674,790 discloses an adjustable armrest for an automobile seat wherein the armrest is pivotal and may be set at any preselected height position. The Miller U.S. Pat. No. 4,069,995 discloses a dynamic column support for an arm used in occupational therapy. The arm support is provided with cable members which are laterally deflectable but which will not compress longitudinally. The purpose of the device is to permit free movement in any horizontal direction relative to a fixed base while maintaining a desired balanced condition in the arm. The Aaras U.S. Pat. No. 4,277,102 discloses a chair having armrests which are vertically and angularly adjustable so as to permit the chair to comfortably receive large and individuals. The Wood U.S. Pat. Nos. 4,913,93 and 4,815,688 also disclose armrests which are adjustably mounted for movement vertically and laterally. The Brink U.S. Pat. No. 4,576,351 discloses an armrest for a stroke victim which provides means for receiving an arm in an adjustable angular position. The Perky U.S. Pat. No. 1,970,816 discloses an armrest supported by a spring which permits the arm to adjust to different arm elevations. The Brodersen U.S. Pat. No. 4,828,323 discloses a self-adjusting armrest which is adjustable both in height and slope by means of a ratchet and pawl support mechanism.

The prior art references do not disclose an active arm support structure which functions in the manner disclosed in the present invention. The adjustable active arm support disclosed herein is specifically designed to eliminate nonessential muscle activity of typists and keyboard operators who work for long periods of time in front of video display terminals and the like. More specifically, it has emerged that physical ailments associated with typing are a major category of work related injuries.

The physical problems of repetitive hand and finger motions can be divided into two separate, though interdependent groups. The first group represents problems which develop to the neck, shoulders, and upper arms as a result of the long term holding of the forearms and hands in an appropriate task-related orientation. This category includes such problems as stiff necks and pain between the shoulder blades. The second category of injuries are called overuse syndromes and these cause impairment to the fingers, wrists, hands and forearms. These conditions are often called 'repetitive motion disorders'. More specific diagnoses include: carpal tunnel syndrome, focal dystonia, trigger finger, tendonitis, etc.

The present invention seeks to overcome these problems by providing task-active forearm and arm support from the elbow to the wrist.

An object of the present invention is to provide compatibility of the active arm support with a particular typist and a particular work station environment. This is accomplished with two specific adjustments. First, the active arm support is laterally adjustable so as to accommodate different body widths. Second, the active arm support is vertically adjustable so as to accommodate different body lengths and workstation heights.

Thus adjusted, another object of the present invention is to provide a work-performing function through active arm support. This is accomplished by the following elements. First, the active arm support pivots horizontally. This pivoting movement is activated simply by the lateral movement of the forearm during typing. More importantly however, a spring hinge is provided which produces a variable, vertical lift on the active arm support while it fully supports the entire forearm. The net result of these support vectors is a spring-assisted universal joint at the elbow.

Specific muscles which are weight supported during keyboard operation include the Deltoids, the Biceps, the Triceps, the finger flexors and extensors, and others.

Other objects and many of the attendant advantages of the present invention will become more readily apparent on consideration of the following detailed specification in connection with the accompany drawings.

DESCRIPTION OF THE PREFERRED EMBODIMENT

Referring now more specifically to the drawings, there is shown at 1 a conventional chair used by a typist, the chair being contoured to provide proper back and leg support for the typist. Attached to the undersurface of the seat of the chair is a support block 2 which serves to support the active arm support structure.

Figure 1:
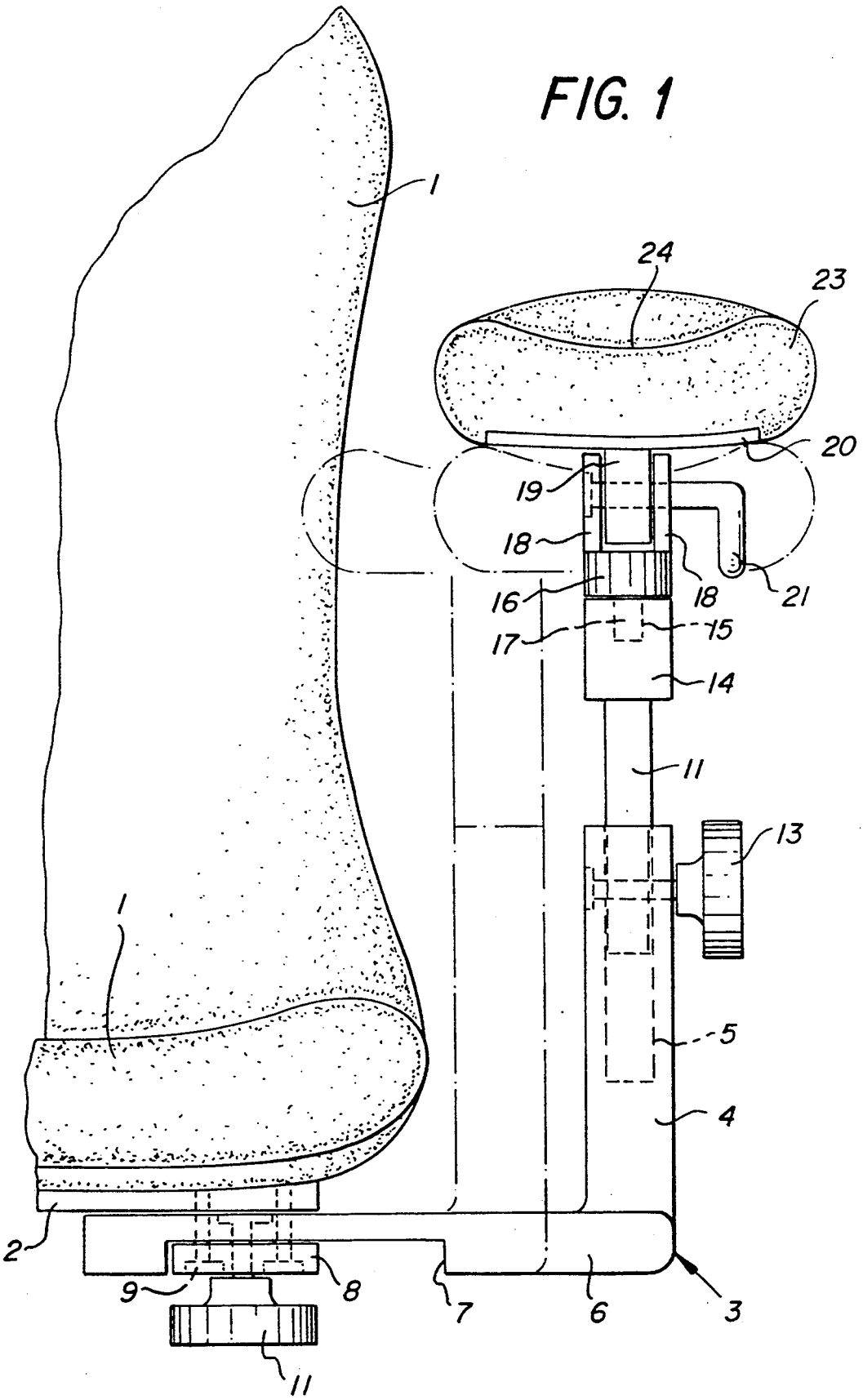
FIG. 1 is a front elevational view of the active arm support showing the attachment of the active arm support to a typist's chair.
Figure 2:
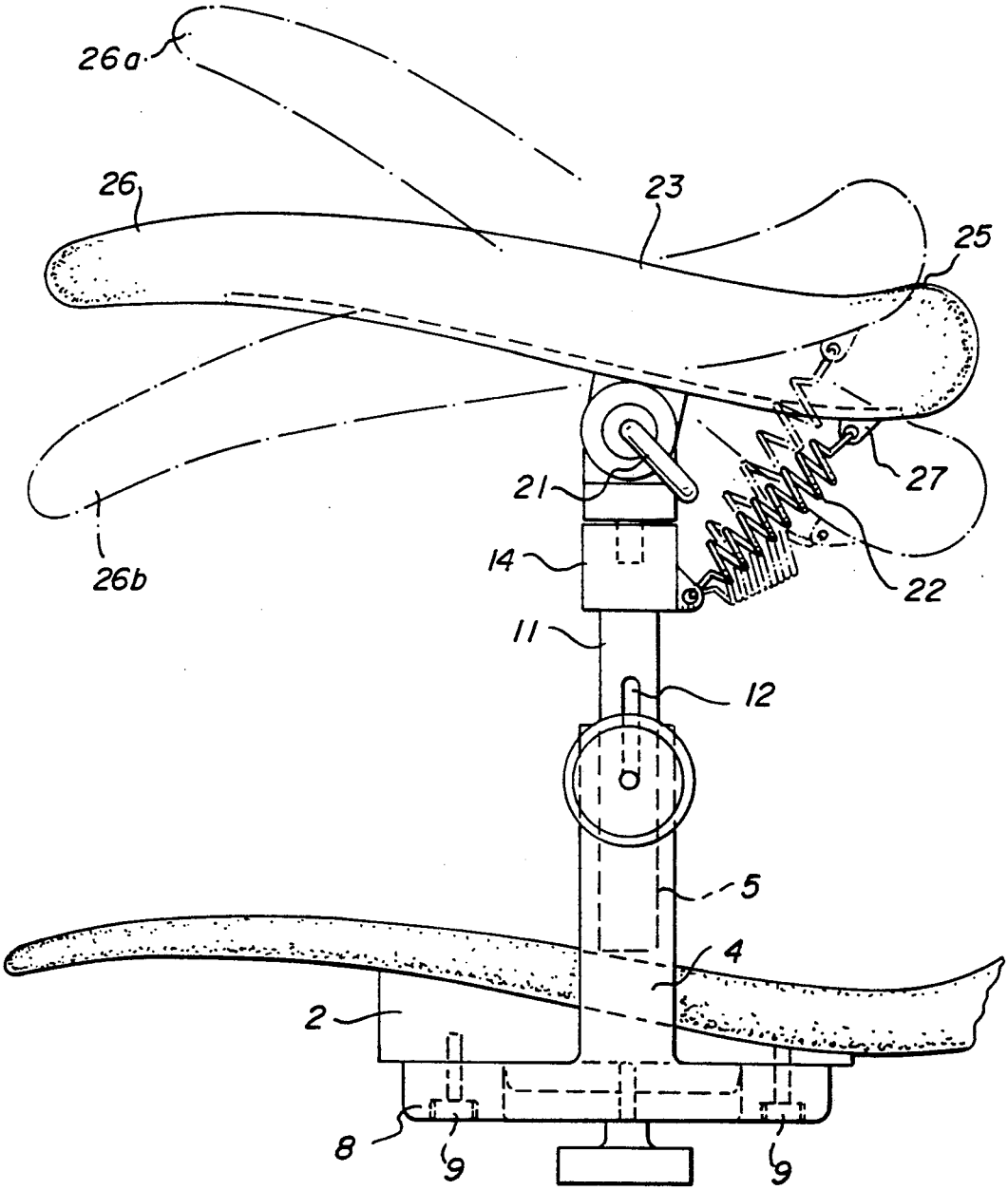
FIG. 2 is a side elevational view of the active arm support shown in FIG. 1, FIG. 3 detailed view of the upright support for securing the active arm support in a preselected position.
Figure 5:
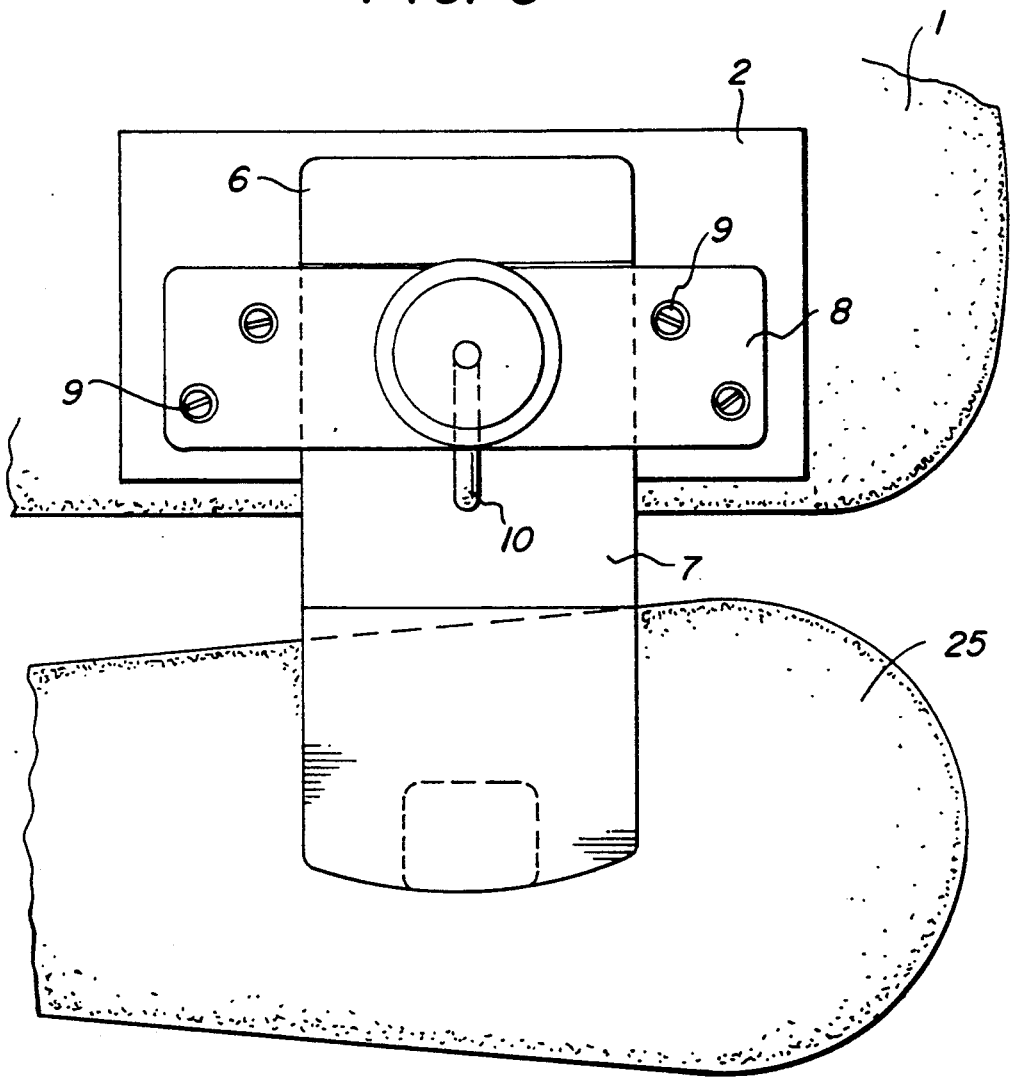
FIG. 5 is a bottom view of the attachment of the active arm support to the chair.

The active arm support comprises an L-shaped supporting arm 3 having an upwardly extending member 4 with a central tubular opening 5 therein. A laterally extending base member 6 is formed integrally with upright 4 or fixedly attached to the upwardly extending member 4. The base member 6 has a reduced slotted section 7 therein. An attachment plate 8 has the end portions thereof secured to the member 2 by means of screws 9 as seen in FIGS. 2 and 5. There is provided a longitudinally extending slot 10 in the base member 6 as shown in FIG. 5. A screw and handwheel member 41 extends through attachment plate 8 and through the slot 10 in base plate 6. Thus, the base plate 6 supporting the active arm support may be moved laterally inwardly and outwardly and the handwheel 41 may be tightened to fix the active arm support in any desired position laterally with respect to the chair.

Figure 3:
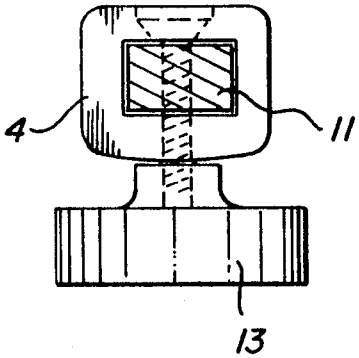

The upright arm 4 with a central bore 5 extending therein is adapted to receive a shaft 11 having a slot 12 therein. A handwheel and screw 13 extends through the slot 12 in shaft 11 as shown in FIG. 3. The handwheel 13 may be loosened to vertically adjust the position of shaft 11 and the shaft may then be locked in any desired vertical position. The upper end of the shaft 11 is provided with an enlarged head portion 14 having a central bore 15 in the upper end thereof. A pivot hinge block 16 is provided with a downwardly extending shaft 17 which is rotatable within bore 15. The upper surface of the pivot hinge 16 has a pair of upstanding spaced arms 18 which are adapted to receive an apertured block 19 which is affixed to a metal armrest support plate 20. A friction lever arm 21 extends through the spaced arms 18 and through a bore in the member 19 and serves as a horizontal pivot pin. The friction lever arm 21 also provides a means to regulate the resistance to pivoting of the armrest vertically.

It can be seen in FIG. 2 there is provided a spring member 22 which extends between member 14 and a flange 27 on the plate 20. The spring 22 urges the front end portion 26 of the active arm support upwardly into position 26*a* and the friction lever 21 adjusts the degree of resistance of movement of the active arm support about the horizontal pivot pin.

The cushioned armrest 23 which may be upholstered, for example, in polyurethane, has a central concave portion 24 with an upward curvature 25 in the rear end portion of the armrest. The upward curved portion 25 of the armrest is adapted to receive the elbow and the armrest is of a length to receive the entire forearm from the elbow to the wrist.

Figure 4:
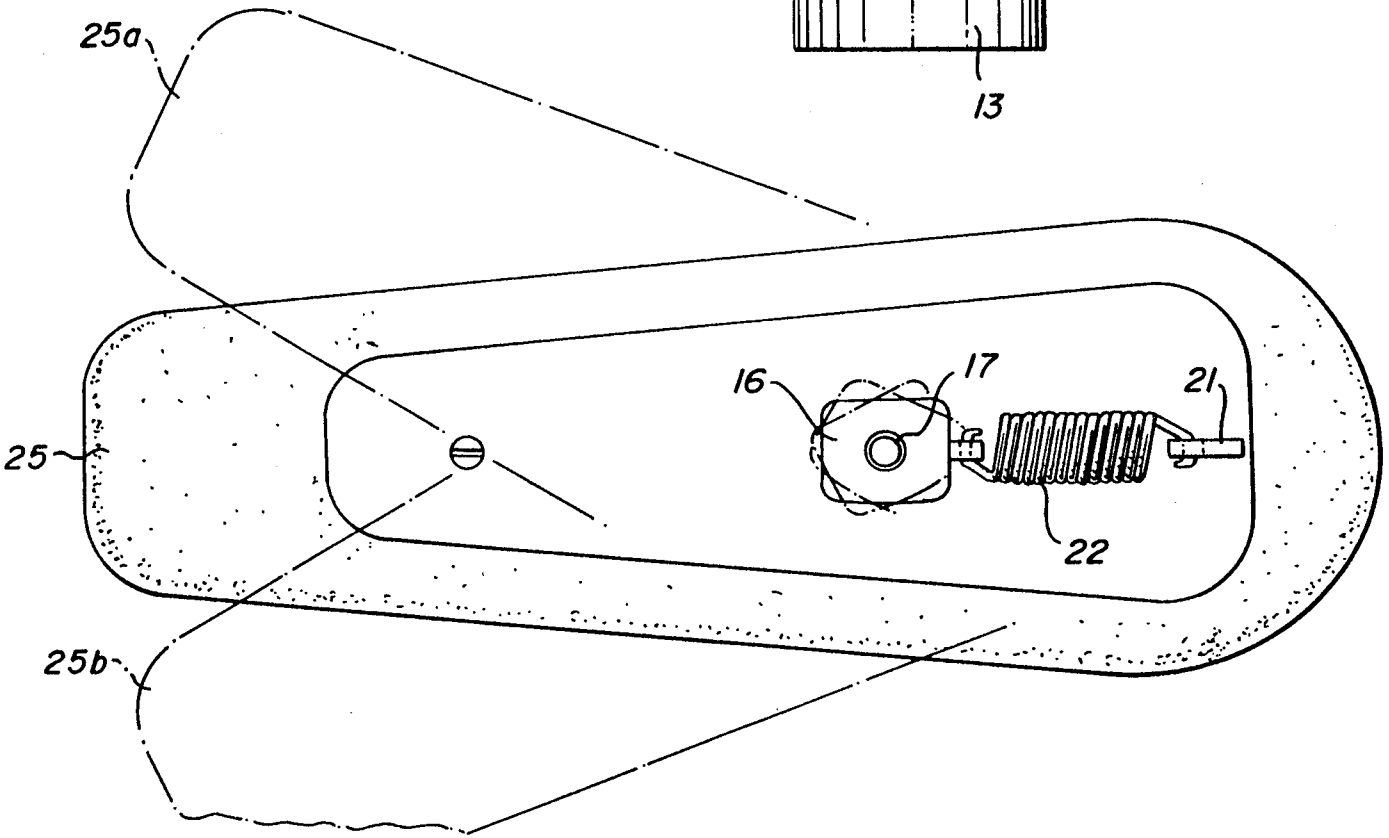
FIG. 4 is a bottom view of the armrest.

It can be seen that the active arm support may be adjusted laterally with respect to the chair by loosening the handwheel 41 and moving the base plate 6 inwardly or outwardly for maximum comfort to the typist. Vertical adjustment of the active arm support is provided by the handwheel 13 which permits the active arm support to be raised or lowered for maximum comfort to the typist. The pivot plate 16 permits the active arm support to be swiveled on the vertical pivot 15 to any desired position. Together, pivots 16/17 and 18/19 constitute, in effect, a universal joint. Additionally, the active arm support is provided with a horizontally extending pivot together with a spring which urges the front end portion 26 of the active arm support upwardly. The friction lever 21 permits the resistance to the movement of the active arm support to be varied as desired. The spring 22 also functions to return the active arm support from positions 25*c* and 25*d* to the normal position of front end portion 26 as shown in FIG. 4.

The active arm support disclosed herein provides full support for the entire arm and forearm during typing, more specifically by means of the hinge with a variable spring which provides assisted vertical lift and thus releases the upper trapezius muscles from efforts to support the arms and forearms. Thus, relaxation of the neck and shoulder muscles is provided.

Obviously many modifications and variations of the present invention are possible in light of the above teachings.

One application, for example, is the attachment of the active arm support to a worksurface rather than a chair, thus providing the same benefits to workers performing repetitive motions while assembling parts such as electronics and other small gear.

What is claimed as new and is desired to be secured by Letters Patent is:

1. An active arm support for a user sitting in a chair comprising, in combination:

a longitudinal armrest having a longitudinal axis and front and rear end portions, a support means for mounting said armrest adjacent the chair and including a support member, a first pivot means for pivotally mounting the armrest relative to said support means for pivotal movement of the longitudinal axis of said armrest in a vertical plane while the user is sitting on a seat of the chair and including an uppermost limit of pivotal movement in the vertical plane of one of said end portions, a second pivot means for pivotally mounting said armrest for pivotal movement relative to said support member of said support means in a generally horizontal plane perpendicular to the vertical plane, and a spring means engaging one of the end portions of the armrest for urging said first-mentioned one of the end portions of said armrest to the uppermost limit of the pivotal movement thereof, for urging the longitudinal axis of said armrest parallel to a vertical plane of symmetry of the chair, and for providing a vertical lift about said first pivot means to said first-mentioned one end portion when moved from the uppermost limit by engagement with a forearm of the user seated on the seat whereby the forearm is actively supported.

2. An active arm support according to claim 1 wherein said spring means is attached at one end thereof to the rear end portion of the armrest and said spring means is attached at the other end thereof to said support means; wherein said support means includes a vertical member having a vertical axis; wherein said second pivot means is separated from said first pivot means; and wherein said spring means is disposed in a vertical plane including said longitudinal axis and is tensioned to urge the front end portion of the armrest upwardly in the vertical plane.

3. An active arm support according to claim 1 and further including means for adjusting a frictional force between said first pivot means, said support means, and said armrest.

4. An active arm support according to claim 1 wherein an upper surface of the armrest is generally concave to receive a forearm of a user from an elbow to a wrist.

5. An active arm support according to claim 1 and further including a means for mounting said armrest for vertical movement with respect to the seat of the chair and a means for locking said armrest in a fixed vertical position with respect to the seat of the chair.

6. An active arm support according to claim 1 and further including a means for mounting said armrest for lateral movement with respect to the seat of the chair and a means for locking said armrest in a fixed lateral position with respect to the seat of the chair.

7. An active arm support for a sitting user comprising, in combination;

a chair having a seat and sides, a pair of armrests, each said armrest including front and rear ends, a respective mounting means for mounting a respective said armrest on each side of the chair, each said mounting means including an L-shaped support having a lower end thereof horizontally disposed and secured to an underside of the seat of the chair and an upper end vertically disposed, a first pivot means for pivotally mounting said armrest to said upper end for pivotal movement about a horizontal axis.

a separate second pivot means for pivotally mounting said armrest to said upper end for pivotal movement about a vertical axis, and a spring means extending between one end of the armrest and the L-shaped support so as to urge the front end of the armrest to pivot upwardly when engaged by a forearm of the user with sufficient vertical lift so that the armrest fully and actively supports an arm and the forearm of the user and relieves tension in the wrists forearms, shoulders and back of the user, and said spring means further, when the armrest is not engaged, returning the armrest parallel to a vertical plane of symmetry of the chair whereby both said armrests when not engaged are parallel to one another.

8. An active arm support according to claim 7 wherein each said first pivot means includes a horizontal pivot and a means for adjusting a frictional force between said horizontal pivot, said upper end and said armrest.

9. An active arm support according to claim 7 wherein an upper surface of the armrest is generally concave to receive the forearm and provide full support for the arm and for the forearm from an elbow to a wrist of the user.

10. An active arm support according to claim 7 and wherein each said mounting means further includes means for adjusting the armrest vertically and laterally with respect to the seat of the chair and means for locking the armrest in a selected position vertically and laterally in relation to the seat of the chair.

* * * * *